US012421847B1

(12) United States Patent
Sanders et al.

(10) Patent No.: US 12,421,847 B1
(45) Date of Patent: Sep. 23, 2025

(54) AIR MOTOR ASSEMBLY

(71) Applicant: Directional Air Drilling International, LLC, Midland, TX (US)

(72) Inventors: Michael P. Sanders, Lexington, KY (US); Michael K. Smith, Midland, TX (US)

(73) Assignee: Directional Air Drilling International, LLC, Midland, TX (US)

( * ) Notice: Subject to any disclaimer, the term of this patent is extended or adjusted under 35 U.S.C. 154(b) by 0 days.

(21) Appl. No.: 19/084,298

(22) Filed: Mar. 19, 2025

Related U.S. Application Data

(60) Provisional application No. 63/567,575, filed on Mar. 20, 2024.

(51) Int. Cl.

| | |
|---|---|
| ***E21B 4/02*** | (2006.01) |
| ***E21B 4/14*** | (2006.01) |
| ***E21B 37/00*** | (2006.01) |
| ***E21B 47/12*** | (2012.01) |
| ***E21B 49/08*** | (2006.01) |

(52) U.S. Cl.
CPC ..... *E21B 47/12* (2013.01); *E21B 4/02* (2013.01); *E21B 4/14* (2013.01); *E21B 49/081* (2013.01); *E21B 37/00* (2013.01)

(58) Field of Classification Search
None
See application file for complete search history.

(56) References Cited

U.S. PATENT DOCUMENTS

| | | | | |
|---|---|---|---|---|
| 4,880,065 | A * | 11/1989 | McDonald | E21B 4/02 173/63 |
| 5,069,298 | A | 12/1991 | Titus | |
| 5,679,894 | A * | 10/1997 | Kruger | E21B 47/06 73/152.01 |
| 5,733,113 | A | 3/1998 | Grupping | |
| 6,827,162 | B2 | 12/2004 | Fisher | |
| 7,204,327 | B2 | 4/2007 | Livingstone | |
| 9,856,730 | B2 | 1/2018 | Butner et al. | |

(Continued)

FOREIGN PATENT DOCUMENTS

| | | | |
|---|---|---|---|
| CA | 2365874 | A1 | 9/2000 |
| CA | 2 356 570 | A1 | 3/2003 |
| WO | WO 2000055468 | A1 * | 9/2000 |

OTHER PUBLICATIONS

International Search Report and Written Opinion issued by the United States Patent and Trademark Office as International Searching Authority for International Application No. PCT/IB2025/052947, dated May 13, 2025. (37 pgs.).

*Primary Examiner* — Tara Schimpf
*Assistant Examiner* — Ursula Lee Norris
(74) *Attorney, Agent, or Firm* — Haynes and Boone, LLP; Randall C. Brown; Michael J. Tobin

(57) ABSTRACT

An air motor apparatus for air drilling includes a filter assembly at an uphole end that receives compressed air and diverts a constant pressure portion through a filter to a vane motor and a remaining portion to an air hammer at a downhole end via bypass conduits. The apparatus includes one or more sensors for measuring drilling conditions, the sensors being connected to a communication device capable of transmitting the sensor data to the surface. The sensors and their wiring are shielded from high air speeds by bypass conduits and components of the filter assembly.

20 Claims, 13 Drawing Sheets

(56) References Cited

U.S. PATENT DOCUMENTS

| | | | | |
|---|---|---|---|---|
| 10,024,103 | B2 | 7/2018 | Lyon et al. | |
| 10,669,781 | B2 | 6/2020 | Lyon | |
| 11,078,736 | B2 | 8/2021 | Lyon | |
| 2004/0104052 | A1 | 6/2004 | Livingstone | |
| 2007/0137897 | A1* | 6/2007 | Sanders | E21B 7/067 175/73 |
| 2015/0060141 | A1* | 3/2015 | Leuenberger | E21B 4/02 175/40 |
| 2016/0069138 | A1* | 3/2016 | Zupanick | E21B 4/18 175/76 |
| 2018/0112468 | A1 | 4/2018 | Savage et al. | |

* cited by examiner

AIR MOTOR ASSEMBLY

CROSS-REFERENCE TO RELATED APPLICATIONS

This application claims priority to U.S. Provisional Patent Application No. 63/567,575, filed on Mar. 20, 2024, entitled "AIR MOTOR ASSEMBLY," the disclosure of which is herein incorporated by reference in its entirety.

TECHNICAL FIELD

The present disclosure relates to an air motor for air drilling and other borehole operations, such as wellbore cleanout. More particularly, the disclosure provides an air motor that may be used with an air hammer, the air motor configured to protect sensitive electrical components and allow for real time monitoring of a borehole operation.

BACKGROUND

Underground directional drilling has been largely limited to drilling with roller cone or polycrystalline diamond compound (PDC) type bits with mud or air-mist rotary drilling motors utilizing rotor-stator or similar technologies. These technologies use liquid-based drilling fluids, which are not conducive to wireless telemetry for real time monitoring of the drilling operation. Portions of the drilling industry use air hammer drilling tools, also known as drill hammers, for conventional straight-hole drilling that strictly use air as the drilling medium. However, rotor-stator technology is not suitable for air hammer drilling tools. Consequently, the air hammer drilling industry has had limited access to the benefits of directional drilling.

BRIEF DESCRIPTION OF DRAWINGS

Embodiments of the subject matter are disclosed with reference to the accompanying drawings and are for illustrative purposes only. The subject matter is not limited in its application to the details of construction, or the arrangement of the components illustrated in the drawings. Like reference numerals are used to indicate like components, unless otherwise indicated.

DETAILED DESCRIPTION

The following descriptions are provided to explain and illustrate embodiments of the present disclosure. The described examples and embodiments should not be construed to limit the present disclosure.

Figure 1:
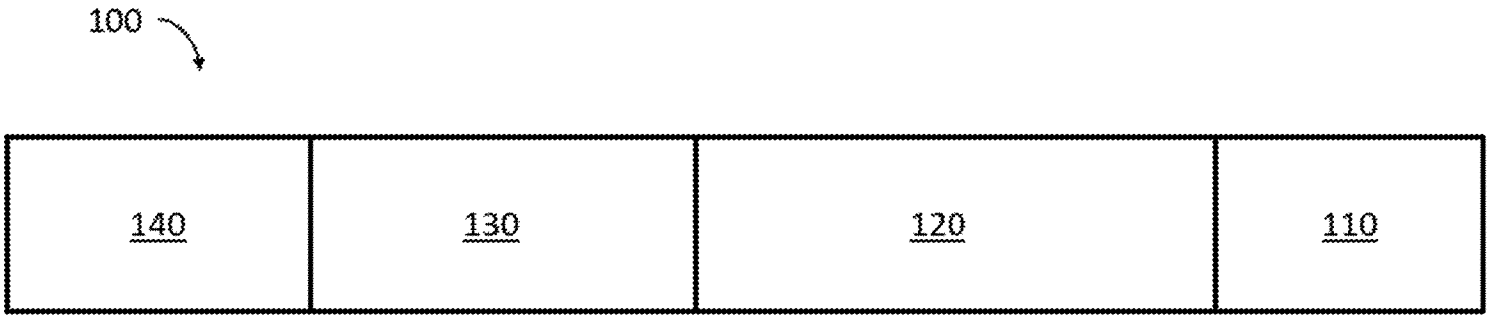
FIG. 1 is a diagrammatic view of an air motor apparatus according to an embodiment of the present disclosure.

Turning to FIG. 1, apparatus 100 includes a filter assembly 110 at an uphole end thereof, a motor assembly 120 adjacent the filter assembly 110, an adjustable bent sub assembly 130 adjacent the motor assembly 120, and a bearing assembly 140 at the downhole end thereof. The filter assembly 110 is configured to connect to a drill string and to receive compressed air therethrough from, e.g., a compressor positioned at the surface of a well. The bearing assembly 140 is configured to connect to an air hammer. The apparatus 100 can be operated with dry compressed air, nitrogen, other gases including, but not limited to, natural gas, or combinations thereof (referred to herein as "compressed air") without the need for liquids to cool and lubricate the motor components, a requirement for most positive displacement motors (PDMs). The ability for air and nitrogen to be used for the drilling process allows for the deployment of a microwave-based communication system that can send and receive data to and from the downhole assembly through the drill pipe. A suitable microwave-based communication system is disclosed in U.S. Pat. No. 9,856,730, which is hereby incorporated by reference in its entirety. The communication link provides for massive amounts of data to be sent up and down the borehole between downhole assemblies and the surface in real time. The tools, systems, and methods described herein may be applicable to a variety of borehole operations, such as mining operations, geothermal well operations, Horizontal Directional Drilling (HDD), oil and gas operations, construction, water well drilling, and others.

Figure 2A:
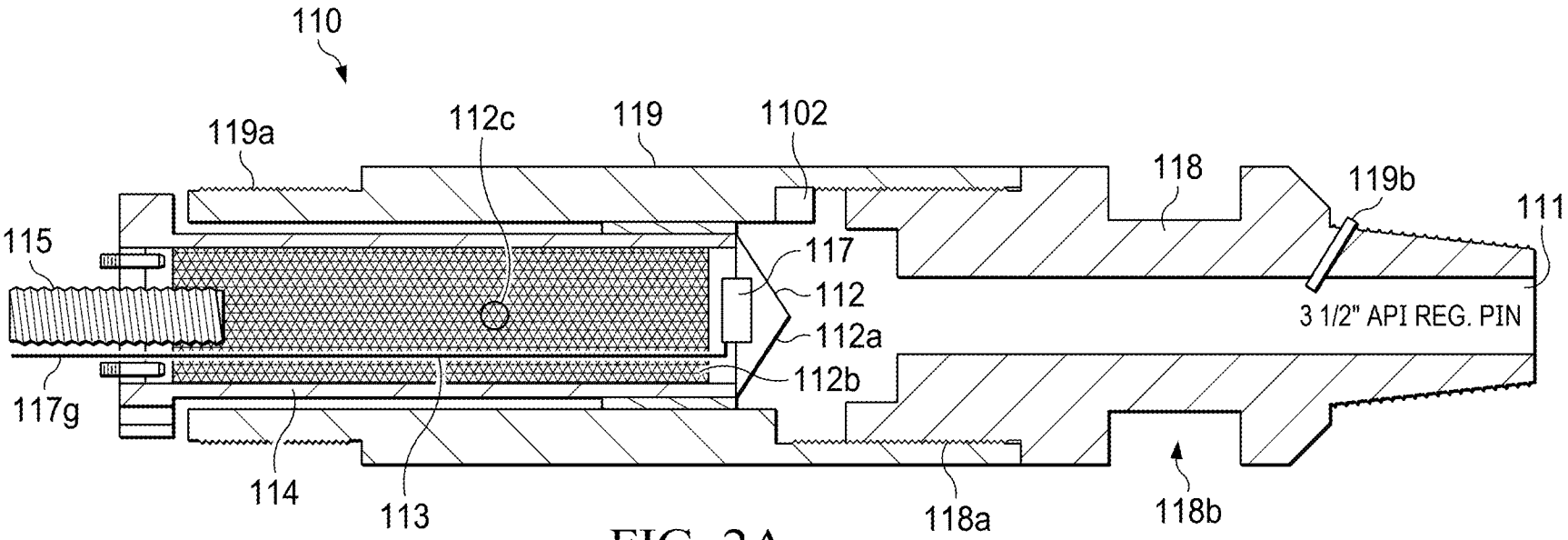
FIG. 2A is a diagrammatic cross-section of a filter assembly according to an embodiment of the present disclosure.

Referring to FIG. 2A, the filter assembly 110 includes an inlet 111 for receiving compressed air. The inlet 111 may be part of a regulator sub 118 attached to the filter assembly housing 119 via thread 118*a*. The regulator sub 118 may also include wrench flats 118*b* for easy attachment to the rest of the drill string. For instance, the wrench flats 118*b* allow for small top drive rigs to hold the apparatus 100 in place with forks during makeup or tripping without the need for bowls and slips. This results in an increased saving of time and increased safety for rig personnel during those operations.

In operation, the compressed air stream flows to the filter canister 112 and initially impacts a filter cone 112*a*. In some embodiments, the filter canister 112 includes cyclone generating features 112*b* to rotate and accelerate the compressed air. The features 112*b* may include spiral vanes or grooves configured to generate a cyclone. The effect of the features 112*b* is to spin the air stream, thereby ejecting particulate matter within the air stream outward and away from the air inlet ports 112*c* leading to the filter 113. This action reduces the buildup of grit on the filter 113, extending its life.

Figure 2B:
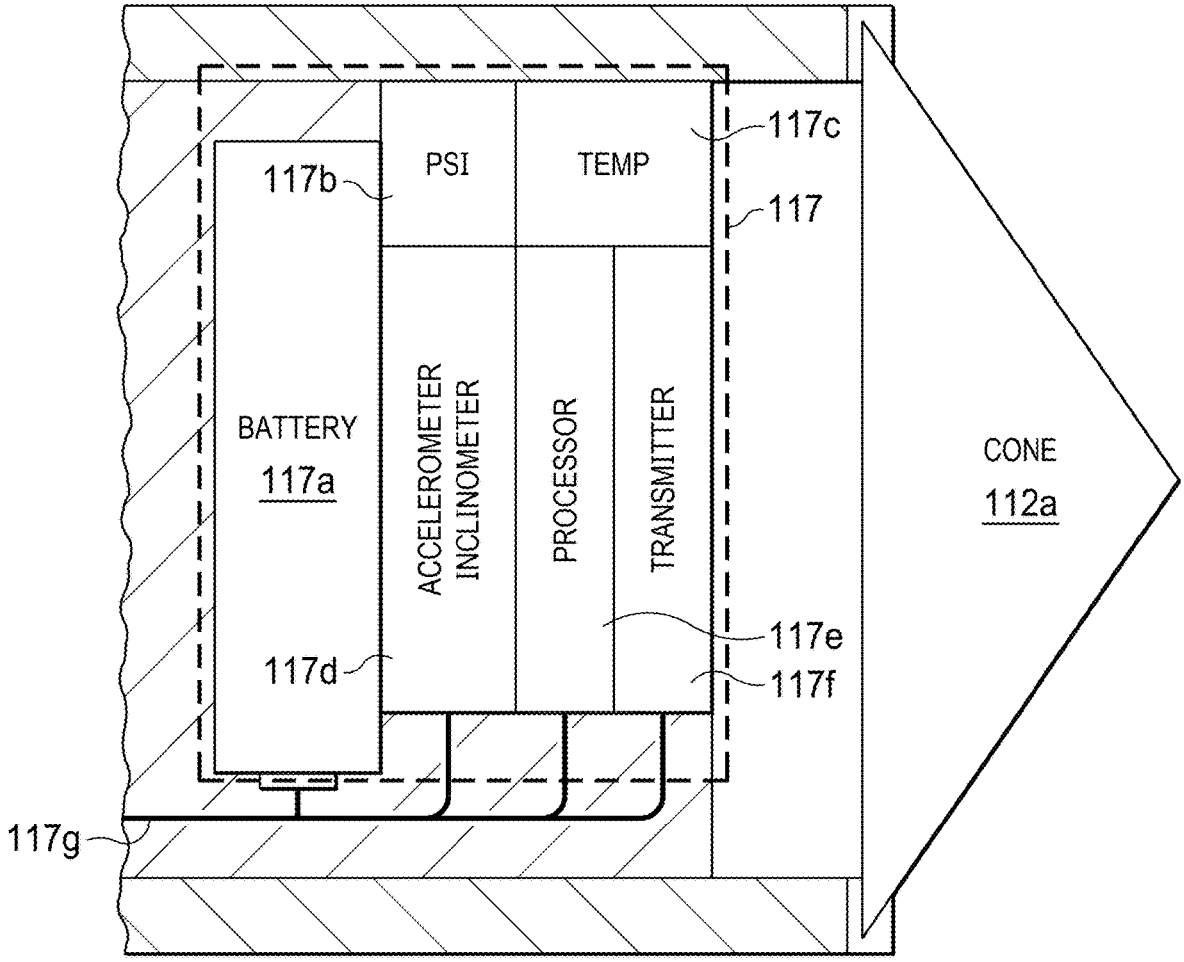
FIG. 2B is an enlarged diagrammatic cross-section of a portion of the filter assembly of FIG. 2A according to an embodiment of the present disclosure.
Figure 3:
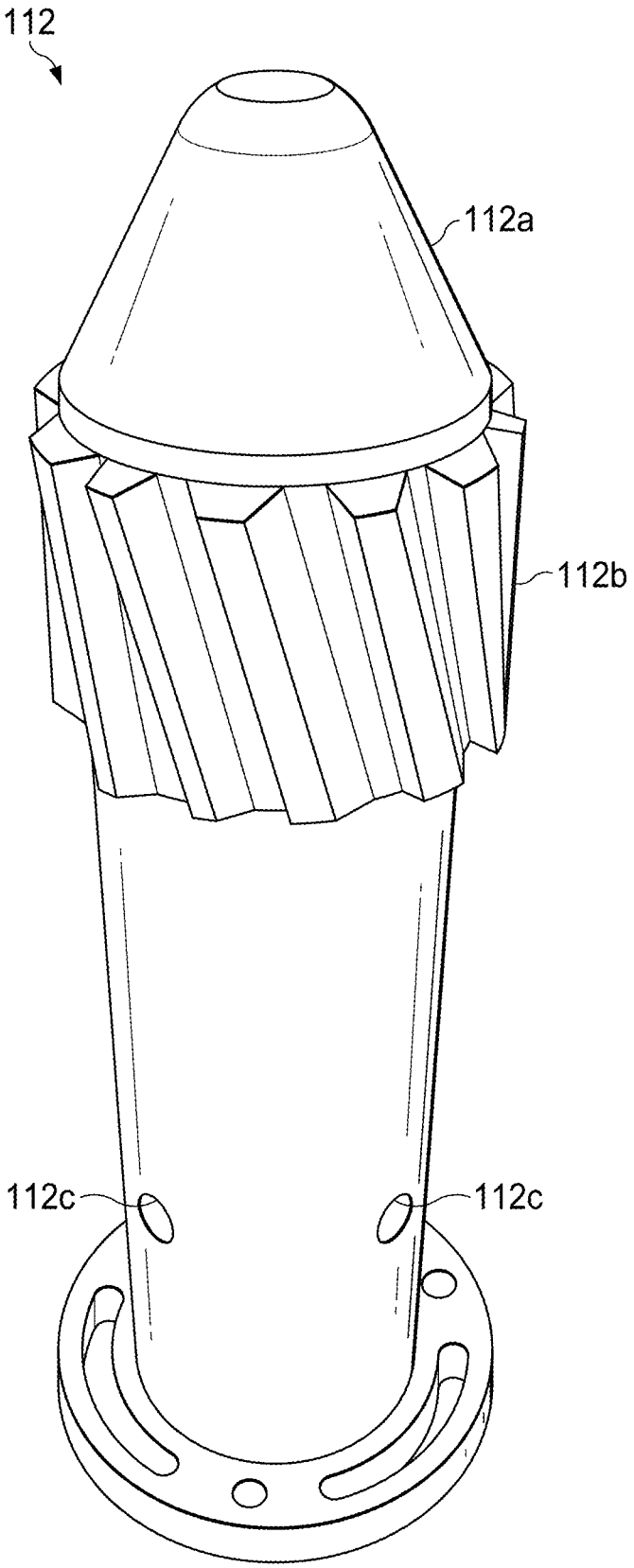
FIG. 3 is a perspective view of a filter canister according to an embodiment of the present disclosure.

The filter canister 112, which is shown in isolation in FIG. 3, serves as a shield between the filter 113 and the air stream, and can serve as housing for a communication hub 117, which is shown in FIG. 2B. The communication hub 117 may include, for example, a battery 117*a* and a communication link between sensors within the apparatus 100 and the surface. In some embodiments, the communication link includes a processor 117*e* and a transmitter 117*f*. In some embodiments, one or more sensors may be included in the communication hub 117, such as a pressure sensor 117*b*, a temperature sensor 117*c*, an accelerometer 117*d*, an inclinometer 117*d*, or combinations thereof. In some embodiments, the communication hub 117 may include a microwave transmitter 117*f* or other suitable communication devices. In some embodiments, the communication link within the communication hub 117 is wireless and wirelessly communicates up the drill string to the surface. In other embodiments, the communication hub may include a wired link to the surface. In some embodiments, the filter cone 112*a* is formed of a material that can withstand the violent compressed air stream directed through the apparatus 100 yet be invisible to microwaves (or other wireless communication frequencies) linking to the telemetry system. For example, in some embodiments, the filter cone 112*a* is formed of TEFLON® (a polytetrafluoroethylene-based composition from The Chemours Company).

An enlarged view of the communication hub 117 according to an embodiment is shown in FIG. 2B. As shown, the communication hub 117 includes a power source 117*a*, such as a battery, for powering one or more components of the communication hub 117. The communication hub 117 may include one or more sensors, such as a pressure sensor 117*b*, a temperature sensor 117*c*, an accelerometer and/or inclinometer 117*d*, or any combinations thereof. In the embodiment shown, the communication hub 117 further includes a processor 117*e* configured to receive data from sensors within the communication hub 117 and/or from sensors elsewhere in the apparatus 100. The communication hub 117 also includes a transmitter 117*f* for wirelessly transmitting data from the processor 117*e* (e.g., data from the sensors) to the surface. A receiver at the surface (not shown) may receive the data from the transmitter 117*f*. The received data may provide real time information about the borehole operation, and operators may adjust parameters of the operation in response to the information. In some embodiments, the communication hub 117 includes wiring 117*g* extending down the apparatus 100 to one or more additional sensors, which are described in more detail below.

Referring again to FIG. 2A, a portion of the air stream flows into the filter 113 via air inlet ports 112*c* of the filter canister 112 while the remainder of the air stream bypasses the filter 113 via filter bypass 114. In some embodiments, the filter 113 may be a 100-micron stainless steel air filter. Filtered air from the filter 113 is directed to the motor assembly 120, as shown in FIGS. 4A and 4B, via filter outlet 115.

In some embodiments, the filter assembly housing 119 or the regulator sub 118 may include one or more jet ports 119*b* upstream of the motor assembly 120 to allow for additional air volume and pressure to be transmitted down the drill pipe and be exhausted into the borehole above the hammer and motor assembly 120 for better bore hole cleaning. Most air drilling rigs operate air compression systems at 350 psi or less, and 1250 cfm or less. When encountering fluids in the well bore, many drillers will increase their air volume and pressure with air boosters in order to help clean out the hole. This increase will often exceed the recommended air flow and pressure requirements for the air hammer causing damage to the hammer and bit. Jet ports 119*b*, in the form of built-in pressure relief valves set at 350 psi, may be built into the top sub apparatus 100. The jet ports 119*b* will only open when the air pressure inside the drill pipe exceeds the set pressure of the valves. This allows most of the additional air, provided by the booster, to be exhausted above the motor. This exhausted air will bypass the air hammer yet still provide for the additional hole cleaning.

In some embodiments, the filter assembly 110 may include one or more sensors 1102 in communication with the communication hub 117. The sensors 1102 may include accelerometers and/or inclinometers or other low power sensors such as a Micro Electromechanical System (MEMs) gyroscope placed to measure tilt and roll of the apparatus 100. The sensors 1102 can be fixed at a precise tilt angle and oriented with the adjustable bent sub assembly 130 so the face direction of the apparatus 100 will always be known relative to the drill string orientation. This is particularly useful during the initial kickoff phase of the drilling, so the bit direction at the bottom of the hole can be accurately oriented. The sensors 1102 may also measure the rotation of the entire bottom assembly both for RPM and smoothness of the rotation when the driller is rotating the entire drill string. This is particularly useful when the drill string is long and the driller is unable to sense these parameters.

Figure 4A:
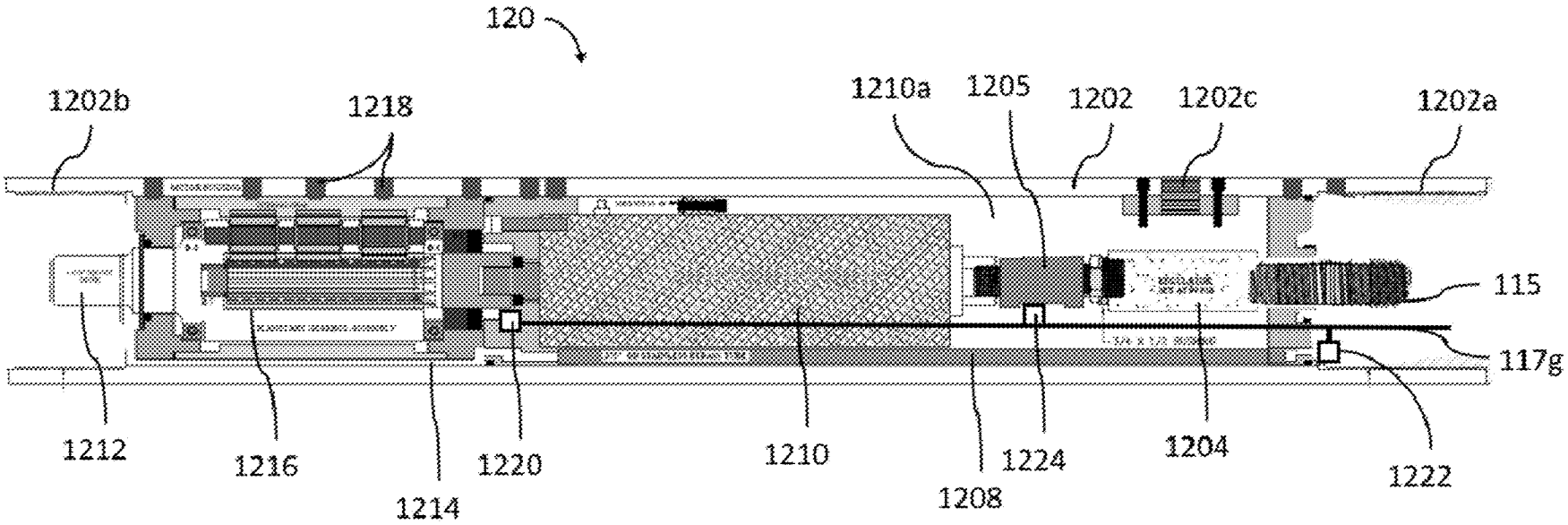
FIG. 4A is a diagrammatic cross-section of a motor assembly according to an embodiment of the present disclosure.
Figure 4B:
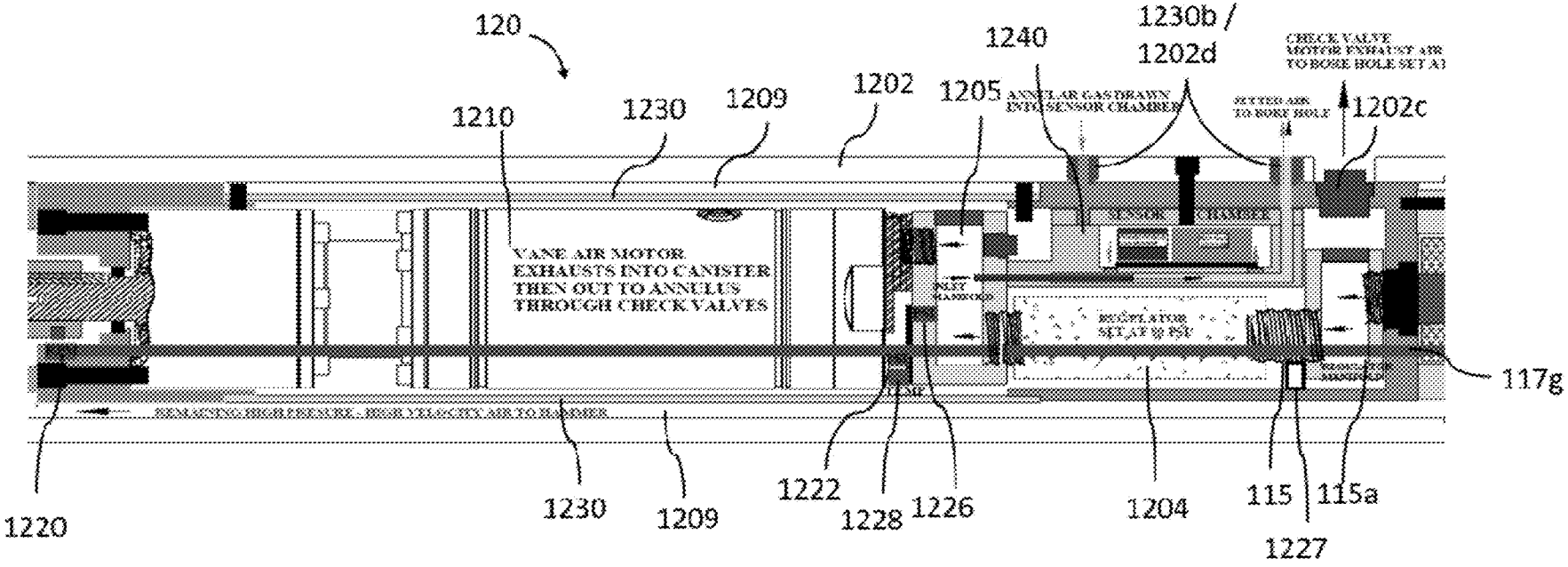
FIG. 4B is a diagrammatic cross-section of a motor assembly according to an embodiment of the present disclosure.

Turning to FIG. 4A, an embodiment of the motor assembly 120 includes a motor housing 1202 that may include threaded portions 1202*a* and 1202*b* for attachment to the filter assembly 110 and the adjustable bent sub assembly 130, respectively. Immobilizers 1218 (such as set screws) are provided to prevent rotation of the vane motor 1210 and/or gear assembly 1216 relative to the motor housing 1202. The motor housing 1202 may further include a pressure relief valve 1202*c*. The valve 1202*c* may be a check valve that is openable when a pressure inside the motor housing 1202 exceeds a borehole pressure. Release of air though the valve 1202*c* may aid in cleanout of the borehole.

Filtered air from the filter outlet 115 passes to a regulator 1204. The regulator 1204 can be set to a desired pressure, e.g., about 90 psi, and thereby provides a constant pressure to the vane motor 1210 via a manifold 1205, which can in turn provide steady rotation speed to the air hammer regardless of the incoming compressed air pressure (though inlet 111). Power generated by the motor 1210 is transferred to the gear assembly 1216 (e.g., a planetary gear assembly) which in turn drives an output 1212 (e.g., a square drive or universal joint) that is linked to the adjustable bent sub assembly 130.

Rotation speed for pneumatic hammer operations may be capped between 30 to 50 RPM. Maximum rotational speed is pre-determined by the regulator 1204 setting inside the motor assembly 120 and the initial vane motor 1210 and gear assembly 1216 configuration. This rotation is independent of fluctuations in air volume or pressure (from inlet 111). Only a small, fixed portion of the air that flows down the drill pipe is required for the power section of the vane motor 1210, while the remaining air is bypassed down to the hammer and bit via bypass tubes 1208, which are in communication with filter bypass 114 of the filter assembly 110. The bypass tubes 1208 are further in communication with motor bypass 1214, which guides the air stream to the adjustable bent sub assembly 130 (and eventually to the hammer).

Operation of the apparatus 100 is distinct from positive displacement motors (PDMs), which will speed up or slow down their rotation speed with increases or decreases of air pressure and air volume. This is because all of the air that flows down the drill pipe and through the bit flows through the power section of the PDM. High air flows will cause high rotation speeds that can cause excessive damage or damage to drill bits and can wear out or damage the elastomer inside the PDM. When a PDM stalls on the bottom of a hole, air flow is halted, and air pressure increases inside the drill string. A rapid and excessive runaway rotation can occur when the tool is lifted off the bottom. This can cause damage to the assembly. More damage can occur when the motor touches back down on the bottom of the hole when the motor is rotating excessively. The motor 1210 of the present disclosure will rotate gradually up to speed to its set maximum rotation speed (e.g., approximately 30 RPM) when lifting off the bottom after a stall. Any air flow increase due to the release of pressurized air inside the drill string during a stall passes through to the hammer and aids in hole cleaning which is a positive result.

The motor assembly 120 may include one or more sensors for monitoring drilling conditions. For example, a speed sensor 1220 may be positioned downhole of the motor 1210 (e.g., between the motor 1210 and the gear assembly 1216) to monitor the rotational speed of the motor 1210. Wiring 117*g* may connect the speed sensor 1220 to the communication hub 117 and may utilize spaces between the bypass tubes 1208 to protect the wiring 117*g* from the air stream. That is, bypass tubes 1208 send the high velocity air past the vane motor chamber 1210*a*. The design provides for additional space for sensors and wiring to be located inside the vane motor chamber 1210*a* so that they are protected from the violent compressed air stream flowing down to the hammer. Sensors that measure air pressure, temperature, shock and vibration, and motor rotation speed can be placed within this chamber 1210*a* or adjacent to the chamber 1210*a*. These sensors will provide the driller with instantaneous critical information regarding the motor performance.

For example, in some embodiments, one or more pressure and/or temperature sensors may be positioned within the motor assembly 120 and in communication with the communication hub 117, e.g., via wiring 117*g* or via wireless communication. For example, a pressure sensor 1224 can be positioned within the motor housing 1202 to measure a borehole pressure or an ambient pressure and a pressure sensor 1222 can be positioned within the air stream bypassing the filter 113 (i.e., the air pressure to be delivered to the air hammer). The communication hub 117 can relay information from the sensors 1220, 1222, 1224 to the surface to provide real time monitoring of the drilling operation, and the data transmitted may be accurately time stamped. Should a failure occur, the moment of failure can be accurately noted with the sensor data. This can greatly aid both the driller and manufacturer with the ability to diagnose the failure and take corrective steps to either continue on with drilling, or to modify future components to mitigate future failures.

With reference to FIG. 4B, an embodiment of the motor assembly 120 is shown. In this embodiment, the motor assembly 120 does not include bypass tubes 1208. Rather, the vane motor 1210 is contained within a motor canister 1230, which forms a plurality of slots 1209 with the motor housing 1202 to allow high velocity air to bypass the motor canister 1230 en route to the air hammer. In some embodiments, the slots 1209 may be isolated from one another or partially connected by circumferential vias. As with the bypass tubes 1208, the motor canister 1230 can isolate sensitive equipment, such as sensors and wiring, from high velocity air and also provide space for housing the same. In some embodiments, the slots 1209 may be substantially connected to one another to form an annulus between the motor canister 1230 and the motor housing. In some embodiments, the slots 1209 may provide greater cross-sectional area as compared with the bypass tubes, thereby allowing increased airflow and lower air pressure and friction pressure.

Figure 4C:
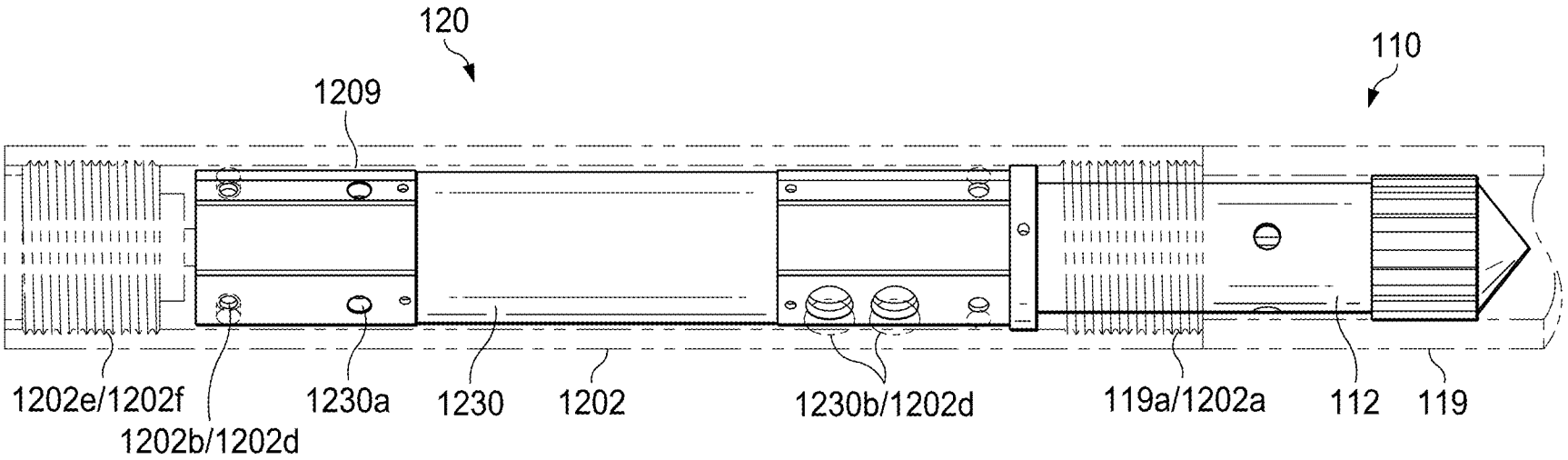
FIG. 4C is a partial sectional view of an air motor apparatus according to an embodiment of the present disclosure.

An additional view of the motor canister 1230 is shown in FIG. 4C, wherein the motor canister 1230 may include one or more annular ports 1230*a* providing fluid communication between an interior of the motor canister 1230 and the slots 1209, e.g., via valves. In some embodiments, the vane motor 1210 may exhaust into the motor canister 1230 and then into the slots 1209 via check valves at the annular ports 1230*a*. The motor canister 1230 may also include one or more borehole ports 1230*b* that are aligned with motor housing ports 1202*d* providing fluid communication between an interior of the motor canister 1230 and the borehole, e.g., via valves 1202*c*. In some embodiments, the borehole ports 1230*b* may be used to sample borehole gas and/or exhaust air or sampled borehole gas into the borehole. In some embodiments, the motor housing ports 1202*d* may be used to house immobilizers 1218, such as set screws, to prevent rotation of the vane motor 1210 relative to the motor housing 1202.

Figure 4D:
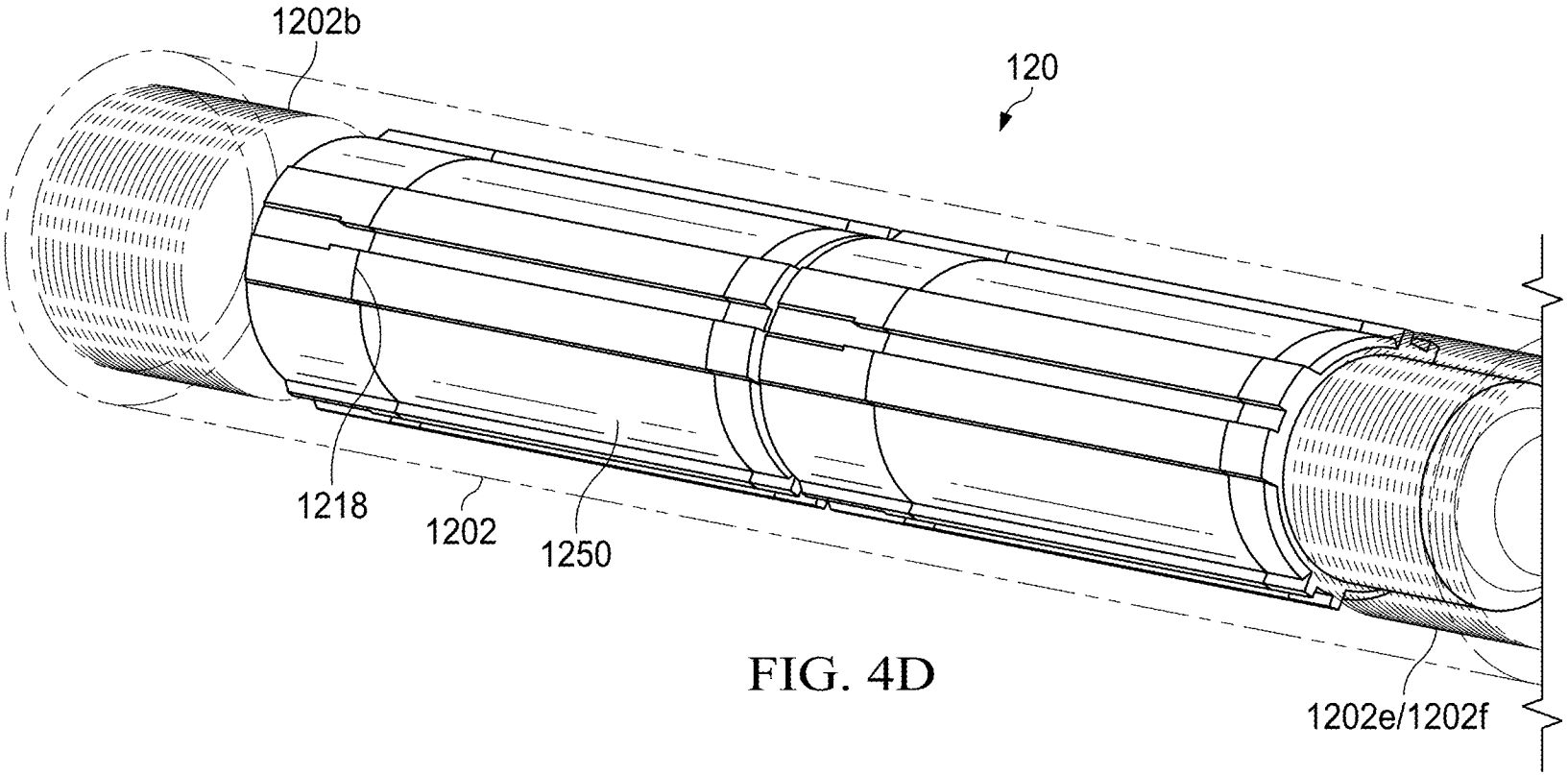
FIG. 4D is a partial sectional view of an air motor apparatus according to an embodiment of the present disclosure.

Although not shown in FIG. 4B, the motor assembly 120 includes a gear assembly 1216, output 1212 and thread portions 1202*b* as described above and shown in FIG. 4A. In some embodiments, the motor housing 1202 may comprise two or more connected segments. For example, as shown in FIGS. 4C and 4D, the motor housing 1202 may include a threaded portions 1202*e* and 1202*f* connecting a first motor housing segment about the vane motor 1210 with a second motor housing segment about the gear assembly. Likewise, any of the housing elements described herein may be unitary or comprised of two or more connected segments. Such configurations may allow for greater flexibility in construction and/or maintenance of the apparatus, wherein added threaded portions may provide access to internal components positioned within the respective assemblies. Referring to FIG. 4D, in some embodiments, the immobilizers 1218 comprise splines formed in a gear housing 1250 containing the gear assembly 1216. As shown, the splines may include a groove in the gear housing 1250 with corresponding protrusions in the motor housing 1202 positioned therein to prevent rotation of the gear assembly 1216 relative to the motor housing 1202.

Figure 4E:
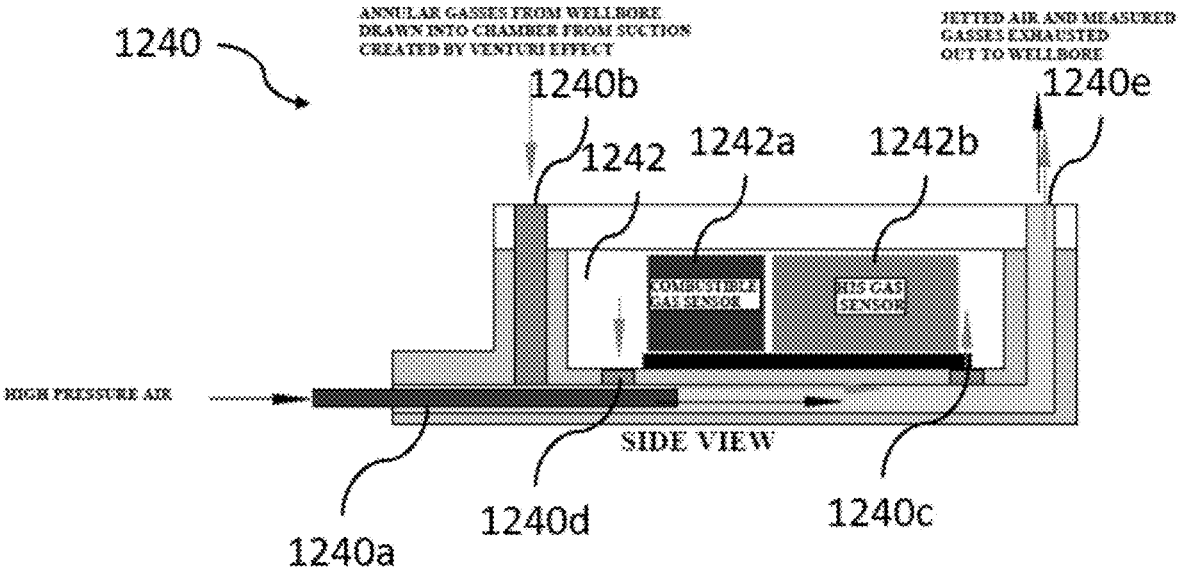
FIG. 4E is a diagrammatic cross-section of the gas sensor of FIG. 4B according to an embodiment of the present disclosure.
Figure 4F:
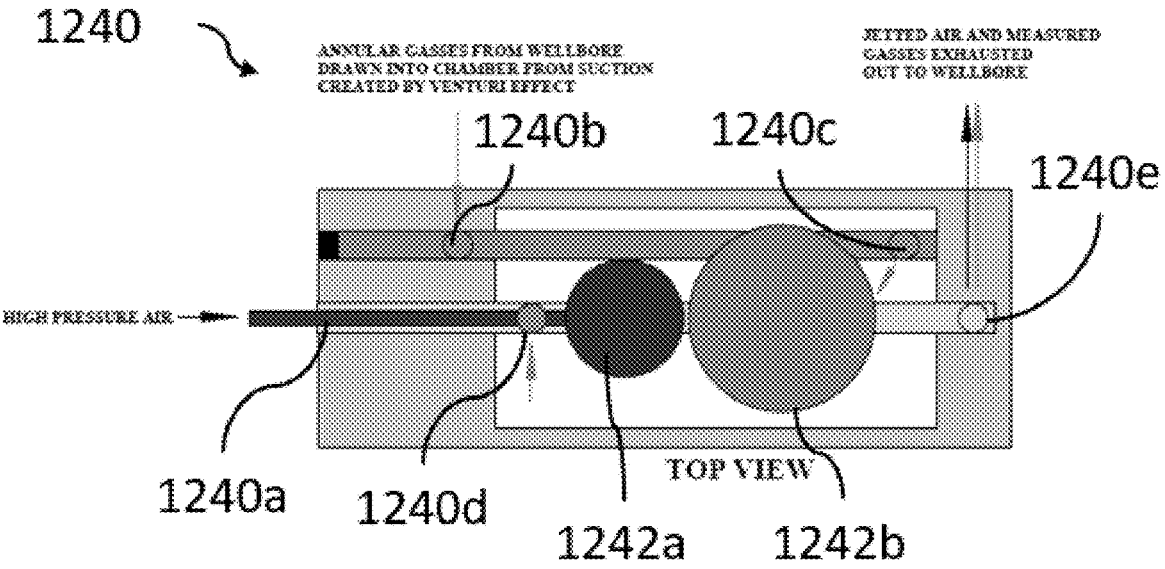
FIG. 4F is a top view of the diagrammatic cross-section of FIG. 4E.
Figure 4G:
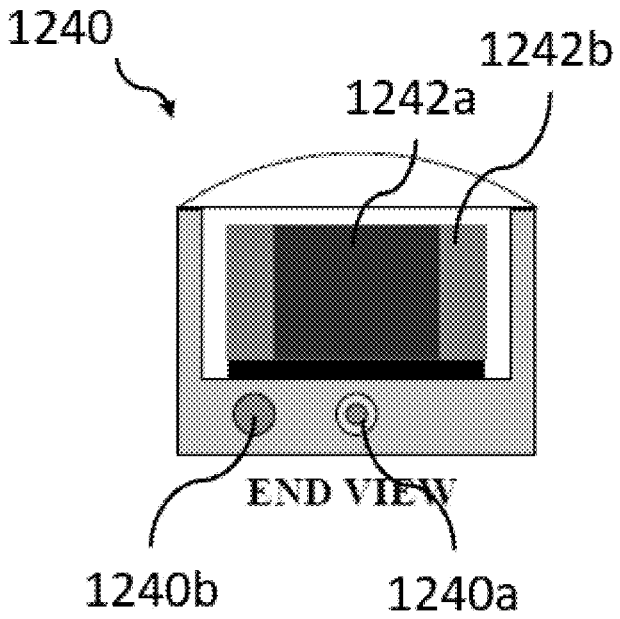
FIG. 4G is an end view of the diagrammatic cross-section of FIG. 4E.

Returning to the embodiment shown in FIG. 4B, the motor assembly 120 includes a pressure sensor 1226 configured to measure air pressure within the manifold 1205, a shock or vibration sensor 1227, and a temperature sensor 1228 to measure a temperature within the motor canister 1230, each of which may be in wired (via wiring 117*g*) or wireless communication with the communication hub 117. The motor assembly 120 further includes a gas sensor 1240 for identifying borehole gas content, the gas sensor 1240 being in fluid communication with the borehole via borehole ports 1230*b* and motor housing ports 1202*d*. The gas sensor 1240 is shown in additional detail in FIGS. 4E-4G. The gas sensor 1240 is provided with high pressure air from the manifold 1205, which accelerates through a venturi nozzle 1240*a* and decelerates past the end of the nozzle 1240*a* creating a vacuum. The vacuum draws in sample borehole gases from a sensor inlet 1240*b* (through borehole port

1230*b* and motor housing port 1202*d*), which is in fluid communication with a sensor chamber 1242 via a sensor chamber inlet 1240*c*. The sensor chamber 1242 may include one or more gas sensors, such as a combustible gas sensor 1242*a* and an $H_2S$ gas sensor 1242*b*, configured to measure gas content of the sample borehole gas drawn into the sensor chamber 1242. The sensor chamber 1242 is in fluid communication with the nozzle 1240*a* (or the vacuum created thereby) via a sensor chamber outlet 1240*d* and the sample borehole gases that have been measured are removed and exhausted via sensor outlet 1240*e* (through borehole port 1230*b* and motor housing port 1202*d*). In some embodiments, the sensor inlet 1240*b* may be positioned about 10 feet above the bit (e.g., air hammer) and be free from contamination from uphole gas entries. The gas sensor 1240 may be in wired (via wiring 117*g*) or wireless communication with the communication hub 117 to provide instantaneous transmission of gas content data to the surface with precise entry point and time of entry information. According to embodiments of the present disclosure, gases such as methane and $H_2S$ can be detected almost immediately when encountered by the drilling operation. The $H_2S$ sensor 1242*b* will warn the driller and crew of a hazard immediately and provide valuable time for safety actions to take place before the dangerous gas reaches the surface. Additionally, combustible gasses can be logged immediately when encountered as to the depth and content. Increases and decreases in borehole temperature could indicate the entrance of formation gas into the borehole and serve as an indirect indication of natural fracturing in the formation.

In any embodiment, additional sensors can be placed within the motor housing 1202 and be in communication with the communication hub 117. Any combination of the sensors and sensor positioning described in FIGS. 4A and 4B may be employed, optionally, with additional sensors such as those described above. Any of the sensors may include sampling ports for measuring conditions within the borehole (outside of the apparatus 100).

The various sensors disclosed herein in combination with the communication hub 117 can provide critical information to drillers allowing them to understand downhole conditions in real time and to optimize drilling. This sensor capability can enhance the drilling efficiency and warn of potential motor failure conditions before a failure occurs. Some sensors can also detect borehole conditions and serve as early warnings when dangerous gas is encountered. Several components of the apparatus 100 disclosed herein serve a dual function, being a component for the motor 1210 to function and as a location for the placement of sensors and other electronics. Sensors measuring motor rotation, air pressure both inside and outside the motor, temperature both inside and outside the motor, and shock and vibration may be placed within the apparatus 100.

The apparatus 100 comprises a gear and vane driven motor 1210 that rotates nearly vibration free. PDMs combined with air hammers can cause excessive vibration on the downhole assemblies. Excessive vibration also leads to the failure of the electrical components for many types of downhole measurement devices such as EM and GR tools. The design of the apparatus 100 provides low vibration while also shielding electrical components from compressed air, thereby enabling reliable, real time monitoring of drilling operations.

Figure 5:
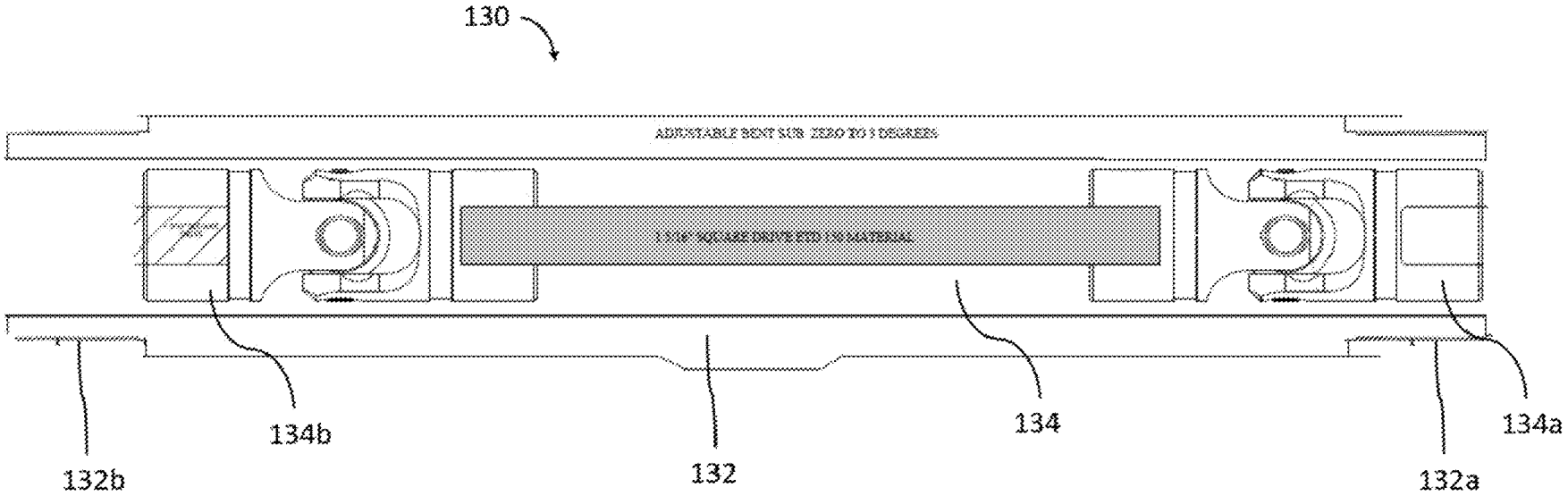
FIG. 5 is a diagrammatic cross-section of an adjustable bent sub assembly according to an embodiment of the present disclosure.
Figure 6:
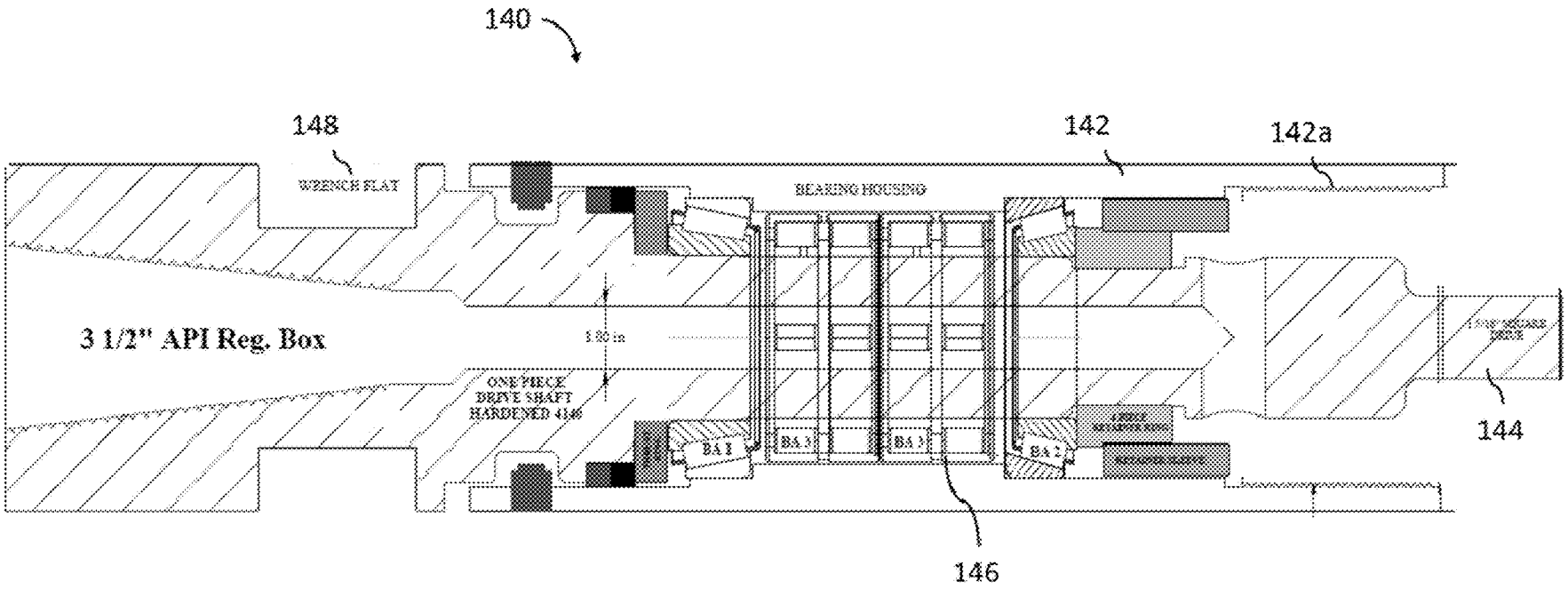
FIG. 6 is a diagrammatic cross-section of a bearing assembly according to an embodiment of the present disclosure.

Turning to FIG. 5, the output 1212 of the gear assembly 1216 is connected to a bent sub joint 134 within the adjustable bent sub assembly 130 at uphole joint 134*a*. The uphole joint 134*a* may be a constant velocity or universal joint which allows for a shaft bend between the motor assembly 120 and the adjustable bent sub assembly 130. The adjustable bent sub assembly 130 includes a housing 132 with threaded portions 132*a*, 132*b* for attachment to the motor assembly 120 and the bearing assembly 140, respectively. A downhole joint 134*b*, which may be the same type as the uphole joint 134*a*, is configured to connect to a shaft 144 of the bearing assembly 140, as shown in FIG. 6. In some embodiments, the adjustable bent sub assembly 130 is configured to be adjustable from 0 to 3 degrees, allowing the apparatus 100 to be used in straight or directional drilling. Air from the motor bypass 1214 may flow into the adjustable bent sub assembly 130, past the bent sub joint 134 and into the bearing assembly 140.

Turning to FIG. 6, the bearing assembly 140 includes a bearing housing 142 with a threaded portion 142*a* for connecting to the adjustable bent sub assembly 130. A downhole end of the bearing assembly 140 is configured to connect to an air hammer and to deliver the air stream that has bypassed the filter 113 to the air hammer. The shaft 144 is connected to the bent sub joint 134 at the downhole joint 134*b* and is configured to rotate the air hammer. The shaft 144 includes a hollow conduit therethrough for delivering the air stream to the air hammer. The shaft 144 may include wrench flats 148 for ease of assembly and installation. A bearing device 146 is included to allow for rotation of the shaft 144 relative to the bearing housing 142.

Figure 7:
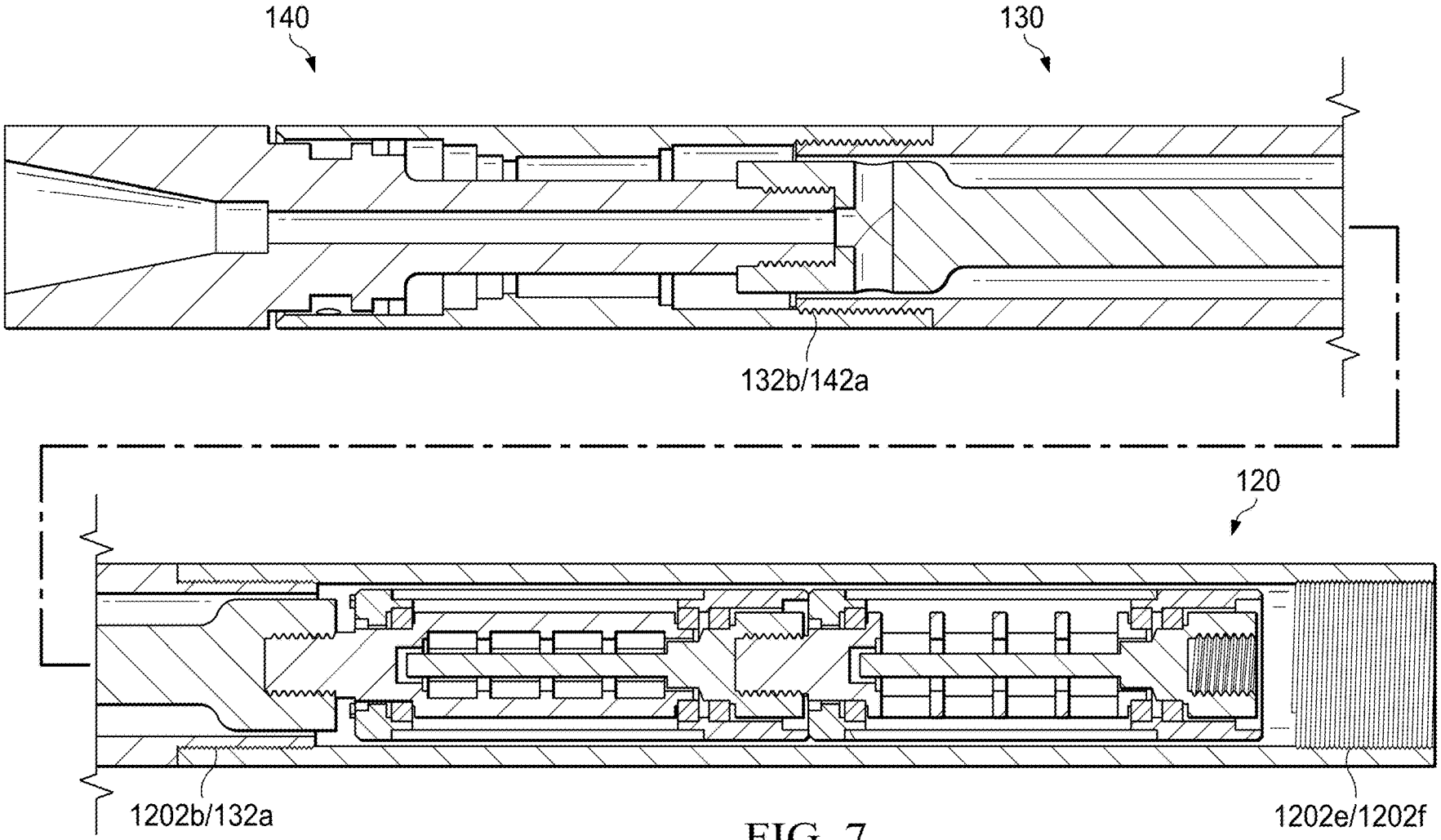
FIG. 7 is a partial sectional view of an air motor apparatus according to an embodiment of the present disclosure.

Referring to FIG. 7, an additional view of the bearing assembly 140, adjustable bent sub assembly 130, and a portion of the motor assembly 120 is shown. The view shown provides additional detail regarding the threaded connections between the various assemblies according to an embodiment of the present disclosure. In the embodiment shown, the motor assembly 120 includes two gear assemblies 1216. In any embodiment, an appropriate number of gear assemblies 1216 may be utilized based on the operational requirements of the apparatus 100.

In one or more embodiments, the apparatus 100 of the present disclosure may have an outer diameter of about 3", about 4", about 6", about 8", about 10", about 12", between about 4" and about 8", between about 3" and about 10", or between about 3" and about 12". Any other suitable size may be employed and the apparatus 100 may be appropriately scaled. In some embodiments, the apparatus 100 is configured to fit within a 5.5" cased well (e.g., a 4" outer diameter). In some embodiments, the apparatus 100 may be used for cleanout operations, such as well cleanout. In this regard, one of the main reasons for low productivity over time from older wells is the buildup of very hard scale inside the casing. Operators need to clean out this scale to increase or restore productivity. Coiled tubing units are typically employed for this task. The PDC and PDM combination used with coiled tubing can often breach the casing since significant weight on the bit must be applied in order to cut through the hard scale. Unfortunately, PDC bits can drill into and possibly through the wall of the softer casing when this bit weight is applied. The loss of the well is possible when this happens. Since the air hammer and air motor combination described herein requires very little weight on the bit for effective drilling, the drilling action can be confined inside the casing and not breach the casing. Also, down the hole (DTH) hammers are very effective in hard formations. Consequently, the air motor and air hammer combination has the ability to drill out this hard scale while not breaching the casing.

Additionally, the apparatus 100 disclosed herein may provide for low rotational and makeup torque and may have a short length. The short tool length allows for the apparatus 100 to be made up within short tower conventional rigs and small horizontal directional drilling (HDD) rigs. Large fleets of small top drive rigs routinely and exclusively drill with air hammers. The short length apparatus 100 allow small rigs to drill deviated and horizontal holes with conventional air hammers. Further, drill rigs may not need high torque makeup tools to employ the apparatus 100 of the present disclosure. The bottom hole assembly can be made up with the equivalent torque that is routinely applied during drill string makeup. That torque is typically generated by the top drive for most pull down rigs. High rotational torque is not required for DTH pneumatic hammers to operate. The cutting action for the DTH bit is supplied by the impact of the buttons of the bit on the formation and not by a scraping mechanism employed by PDC bits. Rotational torque for DTH hammers is only necessary to ensure the buttons on the bit are striking in new spots on the bottom of the hole. The short length and low rotational and makeup torque in combination with the low weight on the bit make the apparatus 100 ideal for small HDD rigs, particularly in very hard rock drilling situations.

The apparatus 100 may also be used in high temperature drilling (e.g., geothermal) because the components thereof can withstand or be insulated from high borehole temperatures. This ability allows for the use of the apparatus in high temperature geothermal drilling applications. On the other hand, PDMs have temperature limitations due to the elastomers used in the power section of the motor.

Although mechanical valves have been disclosed herein, any one or more of the valves of the apparatus 100 may be a remotely controlled valve (e.g., a solenoid valve). The sensors and telemetry system disclosed may be used to communicate with and control such valves.

Although the present disclosure has been described using preferred embodiments and optional features, modification and variation of the embodiments herein disclosed can be foreseen by those of ordinary skill in the art, and such modifications and variations are considered to be within the scope of the present disclosure. It is also to be understood that the above description is intended to be illustrative and not restrictive. Many alternative embodiments will be apparent to those of ordinary skill in the art upon reviewing the above description. Additionally, the terms and expressions employed herein have been used as terms of description and not of limitation, and there is no intention in the use of such terms and expressions of excluding any equivalents of the future shown and described or any portion thereof, and it is recognized that various modifications are possible within the scope of the disclosure.

What is claimed is:

1. An apparatus comprising:

a tubular housing comprising an inlet at an uphole end configured to receive pressurized air and an outlet at a downhole end;

a filter housing within the tubular housing, the filter housing comprising a cone facing the inlet, a cylindrical body, and a filter inlet;

a filter positioned within the cylindrical body of the filter housing and configured to receive a first portion of the pressurized air via the filter inlet;

a communication device within the filter housing positioned between the filter and the cone;

a vane motor downhole of the filter and configured to receive the first portion of the pressurized air from the filter, the vane motor comprising a drive shaft for outputting rotational power;

an air bypass conduit positioned about the vane motor and configured to direct a second portion of the pressurized air past the vane motor;

a speed sensor positioned proximate the vane motor and configured to measure a rotational speed of the drive shaft; and wiring connecting the speed sensor to the communication device, wherein the wiring is isolated from the second portion of the pressurized air by the air bypass conduit.

2. The apparatus of claim 1, further comprising a motor canister positioned about the vane motor;

wherein the air bypass conduit is formed between the tubular housing and the motor canister; and wherein the wiring is disposed at least partially within the motor canister.

3. The apparatus of claim 2, wherein the motor canister comprises a valve configured to exhaust air from the vane motor into the air bypass conduit.

4. The apparatus of claim 2, further comprising at least one pressure sensor positioned in the motor canister and in communication with the communication device.

5. The apparatus of claim 1, wherein the air bypass conduit comprises a plurality of tubes and wherein the wiring is disposed at least partially within interstices between the plurality of tubes.

6. The apparatus of claim 1, wherein the communication device is a wireless communication device.

7. The apparatus of claim 6, wherein the cone of the filter housing comprises a material through which a signal from the wireless communication device can pass.

8. The apparatus of claim 6, wherein the wireless communication device comprises a microwave transmitter and the cone is transparent to microwaves.

9. The apparatus of claim 1, further comprising a gas detection system comprising a gas sampling chamber and a gas sensor within the gas sampling chamber;

wherein the tubular housing comprises a port in fluid communication with the gas detection system and configured to introduce a sample gas from an exterior of the tubular housing into the gas sampling chamber;

wherein the gas sensor is in communication with the communication device; and wherein the gas detection system is at least partially isolated from the second portion of the pressurized air by the air bypass conduit.

10. The apparatus of claim 9, further comprising a motor canister positioned about the vane motor;

wherein the air bypass conduit is formed between the tubular housing and the motor canister; and wherein the gas detection system is at least partially disposed within the motor canister.

11. The apparatus of claim 9, wherein the gas sensor is configured to detect combustible gases, $H_2S$ gas, or a combination thereof.

12. The apparatus of claim 9, wherein the gas detection system comprises a venturi nozzle configured receive air from the first portion of the pressurized air and create a vacuum to draw the sample gas through the port and into the gas sampling chamber.

13. A system comprising:

the apparatus of claim 1, an air compressor configured to generate and deliver the pressurized air to the inlet of the apparatus; and an air hammer connected to the outlet of the apparatus; and wherein the apparatus is configured to direct the second portion of the pressurized air to the air hammer.

14. The system of claim 13, wherein the second portion of the pressurized air drives an axial motion of the air hammer, and the first portion of the pressurized air drives a rotational motion of the air hammer via the vane motor and the drive shaft.

15. The system of claim 14, wherein the apparatus comprises a regulator configured to maintain a constant pressure of the first portion of the pressurized air.

16. The system of claim 13, further comprising a drill string connected to the uphole end of the apparatus.

17. A method, comprising:

directing pressurized air to an apparatus positioned within a borehole, the apparatus comprising:

a tubular housing comprising an inlet at an uphole end configured to receive the pressurized air and an outlet at a downhole end;

a filter housing within the tubular housing, the filter housing comprising a cone facing the inlet, a cylindrical body, and a filter inlet;

a filter positioned within the cylindrical body of the filter housing;

a communication device within the filter housing positioned between the filter and the cone;

a vane motor downhole of the filter the vane motor comprising a drive shaft;

an air bypass conduit positioned about the vane motor;

a speed sensor positioned proximate the vane motor; and wiring connecting the speed sensor to the communication device;

diverting a first portion of the pressurized air through the air bypass conduit past the vane motor;

using the filter and filter inlet, filtering a second portion of the pressurized air to form filtered air;

driving the vane motor with a first portion of the filtered air to rotate the drive shaft;

using the speed sensor, measuring a rotational speed of the drive shaft;

using the wiring, transmitting first data of the rotational speed to the communication device; and using the communication device, wirelessly transmitting the first data to a receiver at a surface of the borehole.

18. The method of claim 17, wherein the apparatus further comprises a gas detection system comprising a gas sampling chamber and a gas sensor within the gas sampling chamber;

wherein the tubular housing comprises a port in fluid communication with the gas detection system and the borehole;

wherein the gas sensor is in communication with the communication device; and the method further comprises:

drawing a sample gas from the borehole into the gas sampling chamber via the port;

using the gas sensor, measuring a gas content of the sample gas;

transmitting second data of the gas content to the communication device; and using the communication device, wirelessly transmitting the second data to a receiver at a surface of the borehole.

19. The method of claim 18, wherein the gas detection system comprises a venturi nozzle; and wherein drawing the sample gas from the borehole comprises directing a second portion of the filtered air through the venturi nozzle to form a vacuum.

20. The method of claim 17, wherein the apparatus further comprises an air hammer proximate the outlet of the tubular housing; and the method further comprises:

directing the first portion of the pressurized air to the air hammer;

driving an axial motion of the air hammer with the first portion of the pressurized air; and driving a rotational motion of the air hammer with the drive shaft.

* * * * *